US009108433B2

(12) United States Patent
Kondo et al.

(10) Patent No.: US 9,108,433 B2
(45) Date of Patent: Aug. 18, 2015

(54) IMAGE FORMING APPARATUS

(71) Applicants: Kazuyoshi Kondo, Tokyo (JP); Kazuyoshi Matsumoto, Tokyo (JP); Makoto Kikura, Kanagawa (JP); Yuuzoh Obata, Tokyo (JP); Norikazu Yanase, Kanagawa (JP); Yoshinori Uchino, Kanagawa (JP); Gaku Hosono, Kanagawa (JP); Tadayasu Enomoto, Kanagawa (JP)

(72) Inventors: Kazuyoshi Kondo, Tokyo (JP); Kazuyoshi Matsumoto, Tokyo (JP); Makoto Kikura, Kanagawa (JP); Yuuzoh Obata, Tokyo (JP); Norikazu Yanase, Kanagawa (JP); Yoshinori Uchino, Kanagawa (JP); Gaku Hosono, Kanagawa (JP); Tadayasu Enomoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/029,016

(22) Filed: Sep. 17, 2013

(65) Prior Publication Data

US 2014/0078232 A1 Mar. 20, 2014

(30) Foreign Application Priority Data

Sep. 18, 2012 (JP) ..... 2012-204824
Jun. 6, 2013 (JP) ..... 2013-119476

(51) Int. Cl.
*B41J 3/407* (2006.01)

(52) U.S. Cl.
CPC ..... *B41J 3/4075* (2013.01)

(58) Field of Classification Search
None
See application file for complete search history.

(56) References Cited

U.S. PATENT DOCUMENTS

| | | | |
|---|---|---|---|
| 5,489,160 | A | 2/1996 | Patrick et al. |
| 5,940,107 | A | 8/1999 | Fox |
| 2005/0024464 | A1 | 2/2005 | Takagi |

FOREIGN PATENT DOCUMENTS

| | | | |
|---|---|---|---|
| CN | 101746125 | A | 6/2010 |
| JP | 7-172006 | | 7/1995 |
| JP | 7-251983 | | 10/1995 |
| JP | 10-35633 | | 2/1998 |
| JP | 2006-168270 | | 6/2006 |
| JP | 2009-262492 | | 11/2009 |
| JP | 2011-178500 | | 9/2011 |

OTHER PUBLICATIONS

U.S. Appl. No. 13/950,473, filed Jul. 25, 2013.
U.S. Appl. No. 13/950,867, filed Jul. 25, 2013.
May 14, 2015 Chinese official action in corresponding Chinese patent application No. 201310425119.9.

*Primary Examiner* — Justin Seo
(74) *Attorney, Agent, or Firm* — Cooper & Dunham LLP

(57) ABSTRACT

An image forming apparatus includes an image forming unit, a conveyance unit, and an adhesive-surface guide unit. The adhesive-surface guide unit includes a second rotary body and an adhesive-surface guide member. The second rotary body is disposed at a position downstream from a first rotary body of a pair of rotary bodies of the conveyance unit in a conveyance direction. The adhesive-surface guide member is wound around the first and second rotary bodies to guide an adhesive surface of a print medium. The adhesive-surface guide unit is configured to press the adhesive-surface guide member against the adhesive surface, sandwich the print medium and the second rotary body between the pair of rotary bodies, move the print medium and the second rotary body together, and separate the adhesive-surface guide member from the adhesive surface at a side of the adhesive-surface guide unit at which the second rotary body is disposed.

11 Claims, 10 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application Nos. 2012-204824, filed on Sep. 18, 2012, and 2013-119476, filed on Jun. 6, 2013, in the Japan Patent Office, the entire disclosure of each of which is hereby incorporated by reference herein.

BACKGROUND

1. Technical Field

This disclosure relates to an image forming apparatus.

2. Description of the Related Art

Image forming apparatuses are used as printers, facsimile machines, copiers, plotters, or multi-functional devices having, e.g., two or more of the foregoing capabilities. For example, there is known an image forming apparatus, such as a label printer, to print on a roll print medium (hereinafter also referred to as "label sheet"), such as a tape and a label sheet, and cut the medium into desired length after printing to form a print medium piece (hereinafter also referred to as "label piece").

As such an image forming apparatus, there is known an apparatus which includes a print head for printing a desired mark on a print surface of a label, a print roller disposed near the print head to press the label against the print head during a printing operation, a release rod disposed at an interval from the print roller, and an endless belt which moves around the print roller and the release rod, in which the label adheres to the belt in the print head and is conveyed to the release rod, and the label is separated from the belt at that position (JP-07-172006-A).

There is also known an apparatus which includes a plurality of conveyance belts for sending a label having no pasteboard, in which a release-assisting roller is disposed between the conveyance belts, and the label runs on the release-assisting roller to release the label from the conveyance belt (JP-2011-178500-A).

If a print medium having an adhesive surface with no release sheet is conveyed to a position opposing an image forming unit by a pair of rollers including a conveyance roller and a pressure roller such that the adhesive surface is placed at a front surface and printed thereon, the pair of rollers and the adhesive surface may adhere to each other between nips of the pair of rollers. As a result, the print medium may not separate from the pressure roller, or a separated state of the print medium may become unstable, thus resulting in unstable conveyance of the print medium. Even if a conveyance belt is used instead of the conveyance roller, similarly, the conveyance of the print medium may become unstable.

BRIEF SUMMARY

In at least one exemplary embodiment of this disclosure, there is provided an image forming apparatus including an image forming unit, a conveyance unit, and an adhesive-surface guide unit. The image forming unit forms an image on an adhesive surface of a print medium. The conveyance unit conveys the print medium to a position at which the print medium opposes the image forming unit with the adhesive surface placed at a front surface side. The adhesive-surface guide unit guides the adhesive surface of the print medium at a position upstream from the image forming unit in a conveyance direction of the print medium. The conveyance unit includes a pair of rotary bodies to sandwich the print medium between the pair of rotary bodies to convey the print medium and a guide member to support and guide the print medium. The pair of rotary bodies includes a first rotary body. The adhesive-surface guide unit includes a second rotary body and an adhesive-surface guide member. The second rotary body is disposed at a position downstream from the first rotary body in the conveyance direction. The adhesive-surface guide member has an endless shape and is wound around the first rotary body and the second rotary body to guide the adhesive surface. The adhesive-surface guide unit is configured to press the adhesive-surface guide member against the adhesive surface of the print medium, sandwich the print medium and the second rotary body between the pair of rotary bodies, move the print medium and the second rotary body together, and separate the adhesive-surface guide member from the adhesive surface at a side of the adhesive-surface guide unit at which the second rotary body is disposed.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
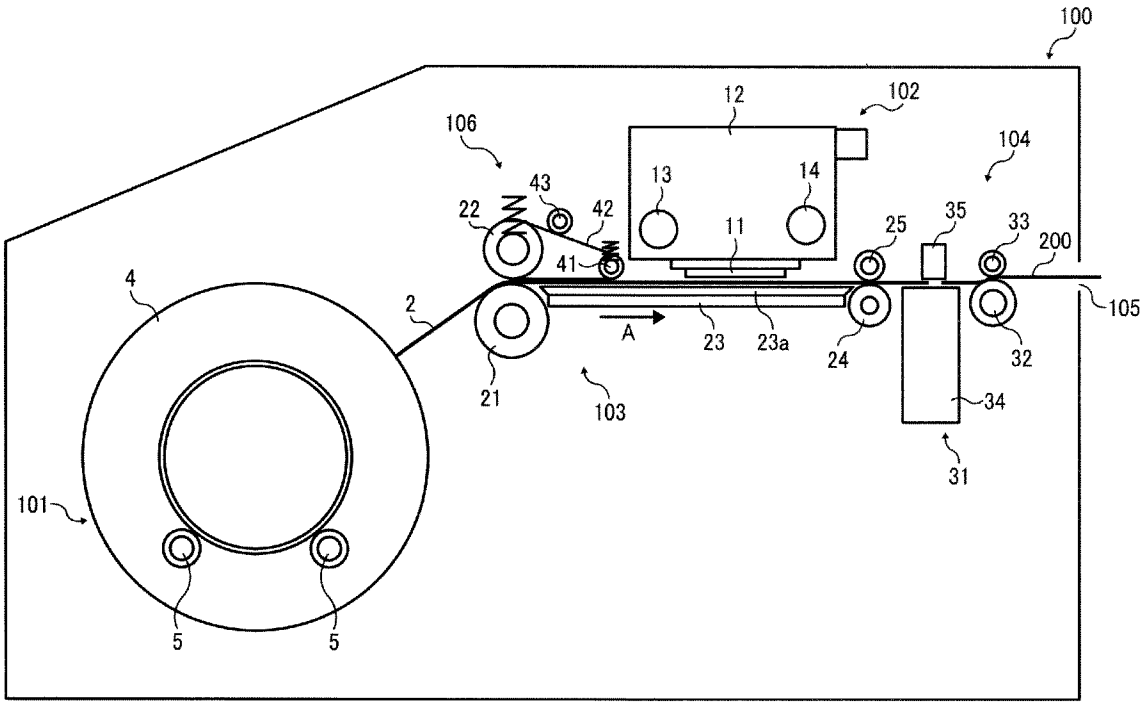
FIG. 1 is a side view of an image forming apparatus according to a first exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

The term "image formation" used herein includes providing not only meaningful images, such as characters and figures, but meaningless images, such as patterns, to print media (in other words, the term "image formation" also includes causing liquid droplets to land on print media).

The term "ink" is not limited to "ink" in a narrow sense, unless specified, but is used as a generic term for any types of liquid usable as targets of image formation. For example, the term "ink" includes recording liquid, fixing solution, liquid, and so on.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to a first exemplary embodiment of this disclosure is described with reference to FIGS. 1 to 3.

Figure 2:
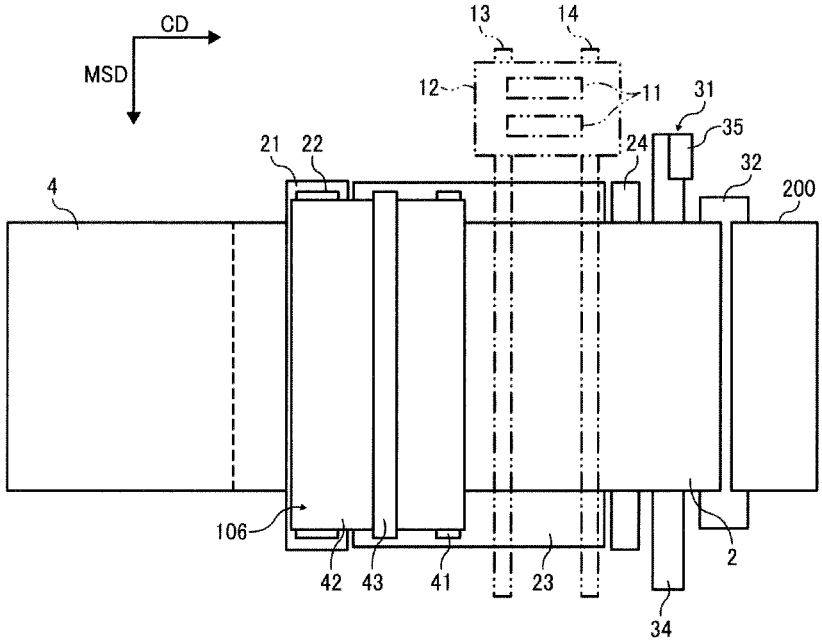
FIG. 2 is a plan view of a portion of the image forming apparatus shown in FIG. 1.

FIG. 1 is a side view of an image forming apparatus according to the first exemplary embodiment of this disclosure. FIG. 2 is a plan view of a portion of the image forming apparatus shown in FIG. 1. FIG. 3 is an enlarged view of an adhesive surface-guide unit shown in FIG. 1.

The image forming apparatus has a sheet feeder 101, an image forming unit 102, a conveyance unit 103 in an apparatus body 100. The sheet feeder 101 feeds print media 2. The image forming unit 102 serves as an image forming unit to form an image on the print medium 2. The conveyance unit 103 as a conveyance unit which is disposed opposing the image forming unit 102 to convey the print media 2. In the apparatus body 100, an output conveyance unit 104 is also disposed to convey a print medium 2 toward an output port 105. The print medium 2 is sent out from the conveyance unit 103 and an image is formed on the print medium 2. An adhesive-surface guide unit 106 is also disposed in the apparatus body 100. The adhesive-surface guide unit 106 guides an adhesive surface of the print medium 2 toward the image forming unit 102 and is conveyed together with the print medium 2.

The sheet feeder 101 is loaded with a roll body 4 composed of a rolled print medium 2. The roll body 4 is rotatably supported by roll body-support members 5.

Figure 3:
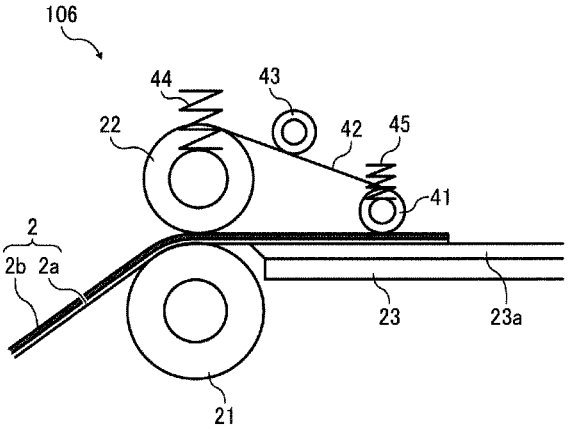
FIG. 3 is an enlarged view of an adhesive surface-guide unit shown in FIG. 1.

As shown in FIG. 3, the print medium 2 is a continuous body formed by forming an adhesive layer (hereinafter also called "adhesive surface") 2*b* on one surface of a medium (hereinafter also called "print surface") 2*a* on which an image can be formed, and a pasteboard (release sheet of paper, separator) is not pasted on the adhesive surface 2*b*.

The print medium 2 is fed or supplied from the sheet feeder 101 in a state in which the adhesive surface 2*b* of the print medium 2 is placed at a front surface side, i.e., an image is formed on the adhesive surface 2*b* by the image forming unit 102.

The image forming unit 102 includes a carriage 12 having a recording head 11 serving as a liquid ejection head to eject liquid drop onto a print medium 2. The carriage 12 is movably held by guide members 13 and 14 and is reciprocally moved in a direction perpendicular to a conveyance direction of a print medium 2 indicated by an arrow CD in FIG. 2.

The recording head 11 includes, for example, two nozzle rows. In this exemplary embodiment, two recording heads 11 are used to eject ink drops of black (K), cyan (C), magenta (M) and yellow (Y) from four nozzle rows. However, the configuration of the recording head is not limited to the above-described configuration. In some embodiments, for example, a line type head is used.

The image forming unit 102 is not limited to the configuration of the liquid ejection head. Various kinds of image forming units to form an image in a contact or non-contact manner can be used.

The conveyance unit 103 conveys a print medium 2 to a position opposing the image forming unit 102 such that the adhesive surface 2*b* is placed at a front surface side. The conveyance unit 103 includes a conveyance roller 21 and a first roller 22 which is disposed opposing the conveyance roller 21. The conveyance roller 21 and the first roller 22 form a pair of rotary bodies to sandwich the print medium 2 and convey the print medium 2 in a direction of an arrow A. The conveyance unit 103 includes a platen member 23 serving as a guide member to guide a print medium 2, a roller 24 on an output side, and a spur 25 opposing the roller 24. A plurality of ribs 23*a* to support a print medium 2 is formed on a surface of the platen member 23. The ribs 23*a* have shapes extending in the conveyance direction CD of a print medium 2.

A cutter unit 31 serving as a cutting unit is disposed on the output conveyance unit 104. The cutter unit 31 cuts a print medium 2 into a desired length to form a print medium piece (label piece) 200. The cutter unit 31 includes a receiving member 34 to receive a print medium 2 which is sent out from between the roller 24 and the spur 25, and a cutter 35 to cut the print medium 2. The cutter 35 moves in a main scanning direction, which is indicated by an arrow MSD in FIG. 2, to cut the print medium 2.

An output roller 32 is disposed downstream of the cutter unit 31. A spur roller 33 is disposed opposing the output roller 32. The output roller 32 and spur roller 33 hold the label piece 200, which is cut by the cutter unit 31, in a state in which the label piece 200 is sent out to the output port 105.

A surface of the output roller 32 to hold the label piece 200 is, for example, non-adherence processed (processed to prevent adherence of an adhesive surface 2*b*) so that the adhesive surface 2*b* of the label piece 200 can come off. In some embodiments, the output roller 32 itself is made of material from which the adhesive surface 2*b* of the label piece 200 can come off.

The adhesive-surface guide unit 106 includes the first roller 22 and a second roller 41. The first roller 22 serves as a first rotary body to form the conveyance unit 103. The second roller 41 serves as a second rotary body and is a separation roller disposed downstream from the first roller 22 and upstream from the image forming unit 102. An endless guide belt 42 serving as an adhesive-surface guide member is wound around the first roller 22 and the second roller 41. The adhesive-surface guide unit 106 also includes a third roller 43 which gives tension to the guide belt 42.

For example, the guide belt 42 is a belt member (belt-shaped member) having a base made of polyimide and a release layer (e.g., silicon coating) as a surface layer of the base. The release layer facilitates separation of the guide belt 42 from an adhesive surface 2*b* of a print medium 2.

The first roller 22 is pressurized toward the conveyance roller 21 by a pressing member 44, e.g., a spring. The second roller 41 is pressurized toward the platen member 23, which is a guide member, by a pressing member 45, e.g., a spring. The third roller 43 serving as a third rotary body comes into contact with an outer circumferential surface of the guide belt 42, and is pressurized toward the guide belt 42 by a pressing member, e.g., a spring.

In the image forming apparatus having the above-described configuration, a print medium 2 pulled out from the roll body 4 is supplied between the conveyance roller 21 and the first roller 22 which are a pair of rotary bodies.

The print medium 2 and the guide belt 42 are sandwiched together between the conveyance roller 21 and the first roller 22, and the conveyance roller 21 is driven to rotate. As a result, the adhesive surface 2*b* of the print medium 2 is sent toward the image forming unit 102 in a state in which the adhesive surface 2*b* and the guide belt 42 are joined together. While the print medium 2 is conveyed, the guide belt 42 comes off from the adhesive surface 2*b* of the print medium 2, and a desired image is formed on the adhesive surface 2*b* by the recording head 11 of the image forming unit 102.

The print medium 2 on which the image was formed is sent to the output conveyance unit 104 and is cut at a desired position by the cutter unit 31 and becomes the print medium piece (label piece) 200. The label piece 200 is held between the output roller 32 and the spur roller 33 in a state in which the label piece 200 is drawable from the output port 105 of the apparatus body 100.

Here, when the print medium 2 is sandwiched between the conveyance roller 21 and the first roller 22, the adhesive surface 2*b* of the print medium 2 comes into contact with a surface layer of the guide belt 42, and the print medium 2 and the guide belt 42 move together by rotation of the conveyance roller 21. As a result, the print medium 2 is conveyed toward the image forming unit 102 in a state in which the adhesive surface 2*b* is protected by the guide belt 42.

A moving direction of the guide belt 42 is n relatively abruptly changed by the second roller 41 having a diameter smaller than that of the first roller 22. Therefore, the guide belt 42 comes off from the adhesive surface 2*b* of the print medium 2, and only the print medium 2 is sent to the image forming unit 102. That is, the guide belt 42 comes off from the adhesive surface 2*b* of the print medium 2 on the side of the second roller 41 which is on the side of the second rotary body.

At this time, since the second roller 41 is pressurized by the pressing member 45 toward the platen member 23, the print medium 2 is pressed against the platen member 23 and the print medium 2 is stably conveyed to the image forming unit 102.

Since the third roller 43 is in contact with the outer circumferential surface of the guide belt 42, even if adhesive is conveyed from the adhesive surface 2*b* of the print medium 2 to the guide belt 42, the adhesive can be removed from the guide belt 42 by again conveying the adhesive from the guide belt 42 to the third roller 43.

The adhesive surface of the print medium is moved while guiding the adhesive surface by the adhesive surface guide member, and the adhesive surface guide member is made to come off from the adhesive surface in this manner before a printing operation. As a result, even if a print medium having an adhesive surface without release paper is conveyed to a position opposing the image forming unit using the pair of rollers, including the conveyance roller and the roller opposing the conveyance roller, such that the adhesive surface is placed at a front surface side, the print medium is stably conveyed.

That is, if a print medium 2 having an adhesive surface 2*b* on which a pasteboard is not pasted is supplied and conveyed as, e.g., a roll body, a large force would be needed to separate the print medium 2 from the roll body due to its adhesive force. Such a large force is created by a nipping portion between the first roller 22 and the conveyance roller 21. To increase the force, the nipping portion may be increased in size to increase a contact area in which the first roller 22 and the conveyance roller contacts the print medium 2 at the nipping portion.

To increase the contact area, it is effective to increase diameters of the first roller 22 and the conveyance roller 21. However, if the diameter of the first roller 22 is increased, a curvature of the first roller 22 is loosened when a print medium is conveyed with an adhesive surface 2*b* placed at a front surface side. As a result, the adhesive surface 2*b* may adhere to the first roller 22 and wind around the first roller 22.

By contrast, If a first roller having a small diameter is employed so that the adhesive surface 2*b* does not wind around the first roller, as described above, the nipping area becomes small. As a result, the print medium 2 may slip between the rollers, thus resulting in unstable conveyance.

Hence, in this exemplary embodiment, the guide belt 42 is wound around two rollers having difference diameters and a print medium 2 is conveyed with the guide belt 42 pressed against an adhesive surface 2*b* of the print medium 2. Such a configuration can obtain a large area of the nipping portion with respect to the conveyance roller 21 and set a large curvature of a release portion from the guide belt 42, thus allowing stable conveyance of the print medium 2.

Additionally, in this exemplary embodiment, the guide belt is not divided, thus preventing sending failure and deterioration of sending accuracy which may be caused by an insufficient pressurizing force. In other words, if the guide belt is divided, an unpressurized region might occur, thus causing failures, such as sending failure or deterioration of sending accuracy due to an insufficient pressurizing force. By contrast, in this exemplary embodiment, using a single guide belt prevents occurrences of such failures.

In this embodiment, to facilitate separation of the guide belt 42 from an adhesive surface 2*b* of a print medium 2, i.e., to facilitate separation of the adhesive surface 2*b* of the print medium 2 from the guide belt 42, for example, a plurality of fine convex portions are preferably formed on the release layer (silicon coating on surface layer) of the guide belt 42.

For example, when glass beads (having a diameter of about 200 μm) are dispersed on the surface layer of the guide belt 42 at a volume rate of, e.g., about 50%, fine convex portions can be formed.

Thus, the contact area of the guide belt 42 with the adhesive surface 2*b* of the print medium 2 is reduced, thus facilitating separation of the guide belt 42 from the adhesive surface 2*b* of the print medium 2.

In some embodiments, a metal roller is used as the second roller 41 on the downstream side, around which the guide belt 42 is wound. Such a configuration suppresses deformation of the second roller 41 caused by tension of the guide belt 42 and by pressure applied on the platen member 23. As a result, the separating attitude of the print medium 2 is stabilized, thus facilitating separation of the guide belt 42 from the adhesive surface 2*b* of the print medium 2.

Next, an image forming apparatus according to a second exemplary embodiment of this disclosure is described with reference to FIG. 4.

Figure 4:
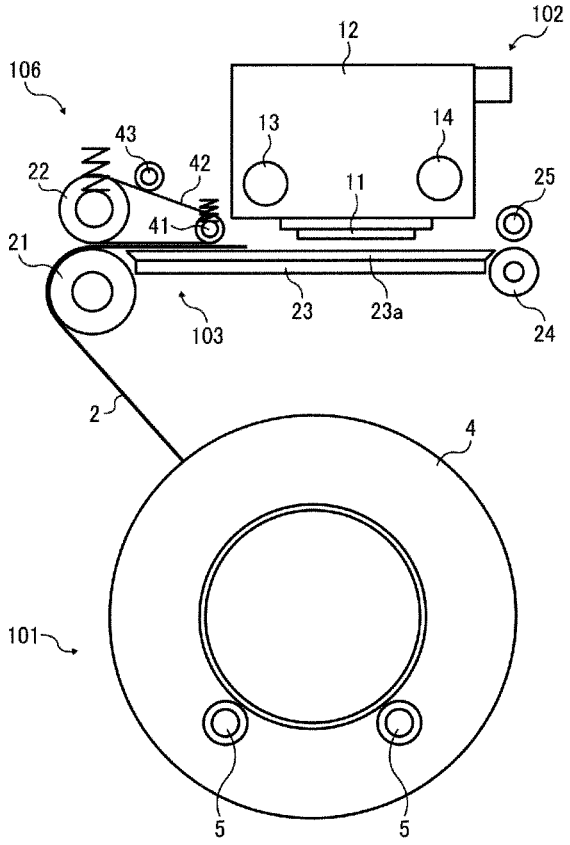
FIG. 4 is a side view of a portion of an image forming apparatus according to a second exemplary embodiment of this disclosure.

FIG. 4 is a side view of a portion of an image forming apparatus according to the second exemplary embodiment of this disclosure.

In the second exemplary embodiment, a roll body 4 of a sheet feeder 101 is disposed below a conveyance roller 21 and downstream from the conveyance roller 21 in a conveyance direction (close to an image forming unit 102).

As a result, the winding amount of a print medium 2 around the conveyance roller 21 can be increased as compared with the first exemplary embodiment, thus increasing the contact area of the print medium 2 with the conveyance roller 21. Such a configuration reduces a pressurizing force against a first roller 22 for supplying the print medium 2 while separating the print medium 2 from the roll body 4.

Accordingly, the adhesion strength between the adhesive surface 2*b* of the print medium 2 and a guide belt 42 can be reduced, thus facilitating separation of the guide belt 42 from the adhesive surface 2*b* of the print medium 2 at a position of a second roller 41.

Next, an image forming apparatus according to a third exemplary embodiment of this disclosure is described with reference to FIG. 5.

Figure 5:
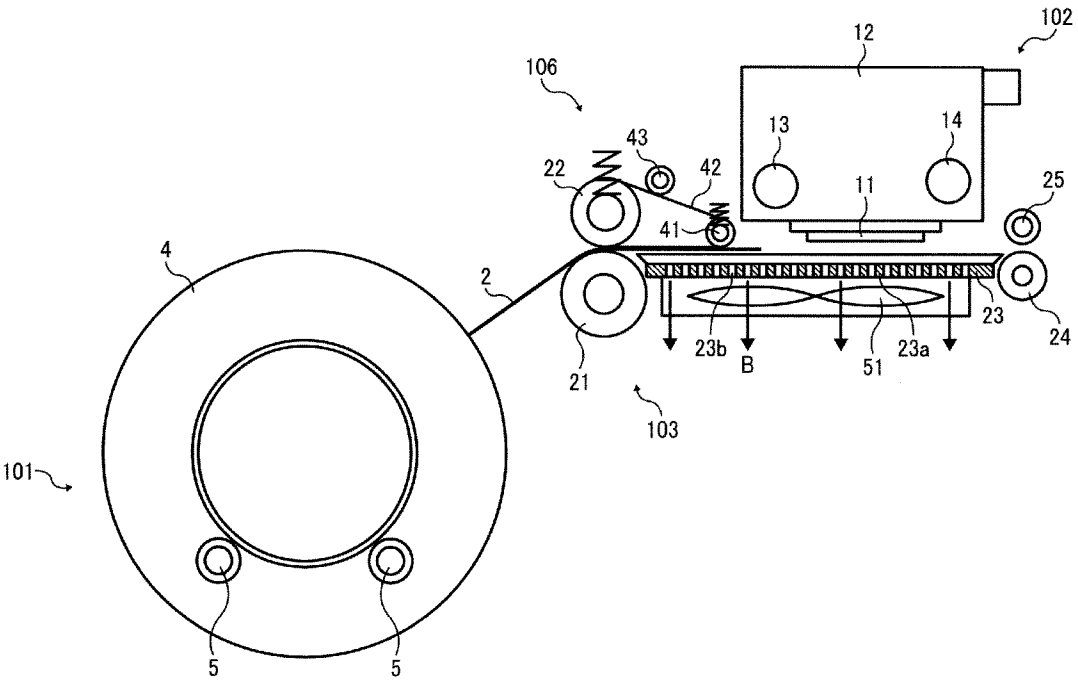
FIG. 5 is a side view of a portion of an image forming apparatus according to a third exemplary embodiment of this disclosure.

FIG. 5 is a side view of a portion of an image forming apparatus according to a third exemplary embodiment of this disclosure.

For the third exemplary embodiment, in the configuration of the first or second exemplary embodiment, a large number of suction holes 23*b* are formed in a platen member 23, and a suction fan 51 as a suction unit is disposed at a back surface side (a side opposite to a side of a recording head) of the platen member 23. In some embodiments, the suction unit is disposed at the back surface side via a member which forms a suction passage from the platen member 23. That is, a guide member includes the suction fan 51 as an absorbing unit to adsorb a back surface side of a print medium 2.

When the print medium 2 is conveyed (also when an image is formed), the suction fan 51 is driven to generate a suction force in a direction of an arrow B through the suction holes 23*b*.

Thus, a force for separating an adhesive surface 2*b* of the print medium 2 from a guide belt 42 is generated, thus facilitating separation of the guide belt 42 from an adhesive surface 2*b* of the print medium 2 without deforming the print medium 2. In addition, since this suction force makes the back surface of the print medium 2 follow a surface of the platen member 23, thus stabilizing the conveyance attitude of the print medium 2.

When the suction fan 51 is provided to assist separation of the adhesive surface 2*b* from the guide belt 42 in such a manner, it is not absolutely necessary that the diameter of a second roller 41 is smaller than that of a first roller 22.

In other words, the guide belt 42 guides and conveys the adhesive surface 2*b* of the print medium 2 between the second roller 41 and a conveyance roller 21 which gives a conveyance force. It is not absolutely necessary to enhance releasability of the adhesive surface 2*b* from the guide belt 42 on a downstream side.

Next, an image forming apparatus according to a fourth exemplary embodiment of this disclosure is described with reference to FIG. 6.

Figure 6:
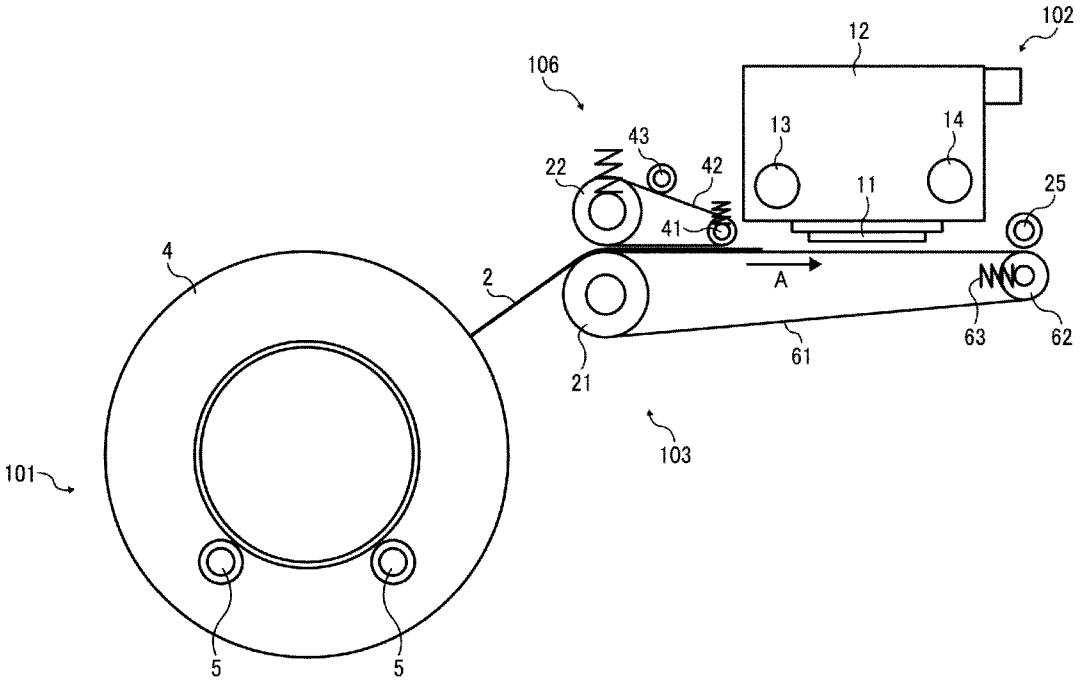
FIG. 6 is a side view of a portion of an image forming apparatus according to a fourth exemplary embodiment of this disclosure.

FIG. 6 is a side view of a portion of an image forming apparatus according to a fourth exemplary embodiment of this disclosure.

For the fourth exemplary embodiment, in the configuration of the first or second exemplary embodiment, an endless conveyance belt 61 wound around a conveyance roller 21 and a driven roller 62 is used as a conveyance unit 103 instead of a platen member 23. The conveyance belt 61 is moved around the conveyance roller 21 and the driven roller 62 in a direction of an arrow A to convey a print medium 2. A spring 63 gives tension to the driven roller 62 in a direction away from the conveyance roller 21.

Use of the conveyance belt 61 stabilizes conveyance attitude of a print medium 2. Since the print medium 2 is sent together with the conveyance belt 61 even after the print medium 2 comes off from the guide belt 42, a sliding load between the print medium 2 and a platen member when the platen member is used is eliminated, thus allowing more stable and precise conveyance of the print medium 2.

Next, an image forming apparatus according to a fifth exemplary embodiment of this disclosure is described with reference to FIG. 7.

Figure 7:
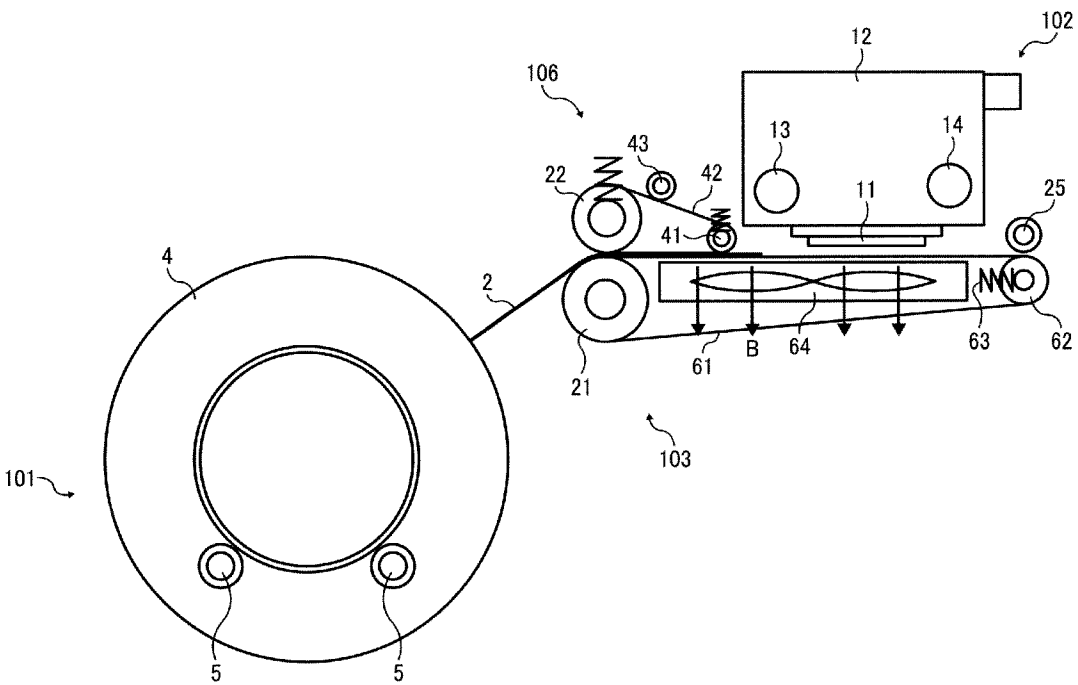
FIG. 7 is a side view of a portion of an image forming apparatus according to a fifth exemplary embodiment of this disclosure.

FIG. 7 is a side view of a portion of an image forming apparatus according to a fifth exemplary embodiment of this disclosure.

For the fifth exemplary embodiment, in the configuration of the fourth exemplary embodiment, a large number of suction holes are formed in a conveyance belt 61, and a suction fan 64 as a suction unit is disposed inside the conveyance belt 61. In some embodiments, the suction unit is disposed inside the conveyance belt 61 via a member that forms a suction passage from a back surface side of the conveyance belt 61.

When a print medium 2 is conveyed (also when an image is formed), the suction fan 64 is driven to generate a suction force in a direction of an arrow B through the suction holes of the conveyance belt 61.

As a result, a force for separating an adhesive surface 2*b* of the print medium 2 is generated in a guide belt 42. Such a configuration facilitates separation of the guide belt 42 from the adhesive surface 2*b* of the print medium 2 without deforming the print medium 2, and stabilizing conveyance attitude of the print medium 2.

For the above-described configuration in which the suction fan 64 is provided to assist to make the adhesive surface 2*b* come off from the guide belt 42, as in the third exemplary embodiment, it is not absolutely necessary that the diameter of a second roller 41 is smaller than that of a first roller 22.

In the fourth and fifth exemplary embodiments, by allowing a surface of the conveyance belt 61 to come off from the adhesive surface 2*b* of the print medium 2 like the guide belt 42 (by forming a release layer, such as silicon coating, to enhance releasability), an image can be formed on a print surface 2*a* of the print medium 2 with the adhesive surface 2*b* facing the conveyance belt 61.

In the third exemplary embodiment shown in FIG. 5 and the fifth exemplary embodiment shown in FIG. 7, a single suction unit collectively sucks, through the guide member, a region from the adhesive-surface guide unit 106 to a region opposing the image forming unit 102.

As a result, the number of suction holes 23*a* blocked by a position of a tip end of the print medium 2 varies. Even if the rotation condition of the suction fan 51 is constant, a suction force applied to the print medium 2 varies.

As a result, when a print medium 2 on which an image has already been formed is cut and the print medium 2 is rewound to again form an image from a tip end position of the print medium 2, the number of suction holes 23*a* blocked by the print medium 2 may be reduced. Accordingly, a suction force in a region opposing the second roller 41 around which the guide belt 42 of the adhesive-surface guide unit 106 is wound might relatively become small, thus hampering separation of the print medium 2 from the guide belt 42.

Hence, a description is given of an exemplary embodiment in which a suction region is divided using a conveyance direction of the print medium 2 so that the print medium 2 can reliably come off from the adhesive-surface guide unit 106.

First, an image forming apparatus according to a sixth exemplary embodiment of this disclosure is described with reference to FIG. 8.

Figure 8:
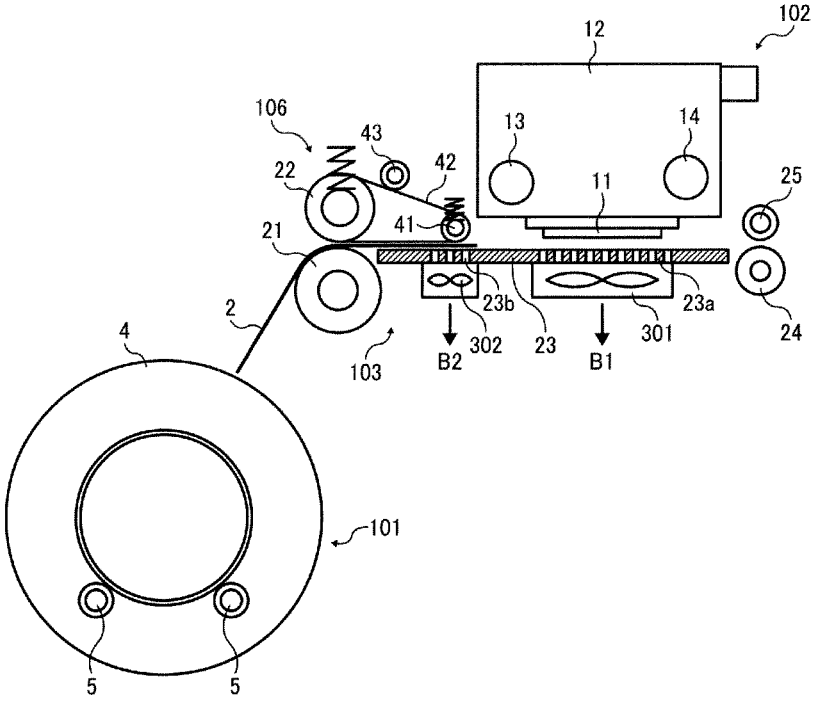
FIG. 8 is a side view of a portion of an image forming apparatus according to a sixth exemplary embodiment of this disclosure.

FIG. 8 is a side view of a portion of an image forming apparatus according to a sixth exemplary embodiment of this disclosure.

In the sixth exemplary embodiment, a plurality of suction holes 23*a* is formed in a first region opposing an image forming unit 102 of a platen member 23, and a plurality of suction holes 23*b* is formed in a second region opposing a second roller 41 of an adhesive-surface guide unit 106.

The image forming apparatus of the sixth exemplary embodiment includes a first suction fan 301 to perform a sucking operation in the first region, and a second suction fan 302 to perform a sucking operation in the second region. The first suction fan 301 and the second suction fan 302 form a suction unit. The first suction fan 301 generates a suction force in a direction of an arrow B1, and the second suction fan 302 generates a suction force in a direction of an arrow B2, thus allowing separately performing the sucking operation in the first region and the second region.

Since the image forming apparatus is configured as described above, a large suction force is applied, by the second suction fan 302, in the region opposing the second roller 41 for separating a print medium 2 from a guide belt 42, thus reliably separating the print medium 2 from the guide belt 42.

Using such different suction fans (first suction fan 301 and second suction fan 302) to independently perform the sucking operations in the first and second regions allows power saving and a reduction in operation noise. For example, when a print medium 2 which can easily be separated from the guide belt 42 is used, the second suction fan 302 can be stopped.

Next, an image forming apparatus according to a seventh exemplary embodiment of this disclosure is described with reference to FIG. 9.

Figure 9:
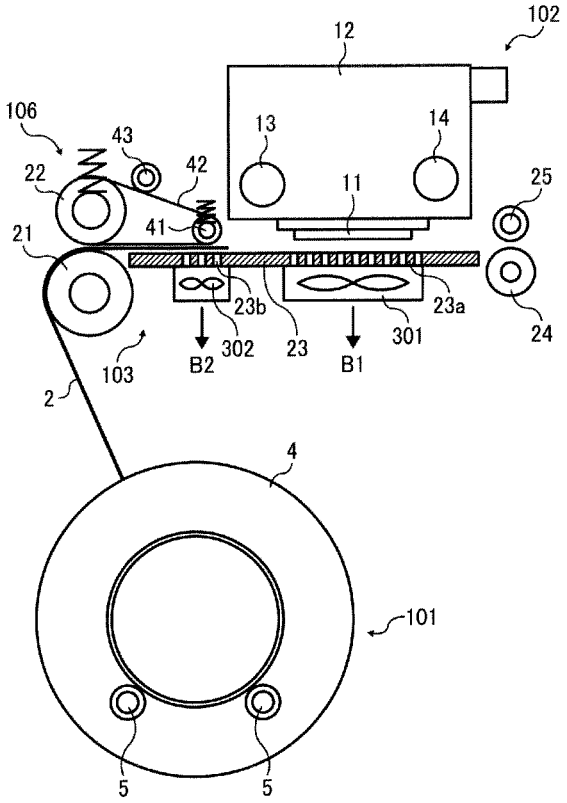
FIG. 9 is a side view of a portion of an image forming apparatus according to a seventh exemplary embodiment of this disclosure.

FIG. 9 is a side view of a portion of an image forming apparatus according to a seventh exemplary embodiment of this disclosure.

For the seventh exemplary embodiment, the sucking configuration of the sixth exemplary embodiment is applied to the configuration of the second exemplary embodiment, thus giving the operation effects of the second and sixth exemplary embodiments.

Next, an image forming apparatus according to an eighth exemplary embodiment of this disclosure is described with reference to FIG. 10.

Figure 10:
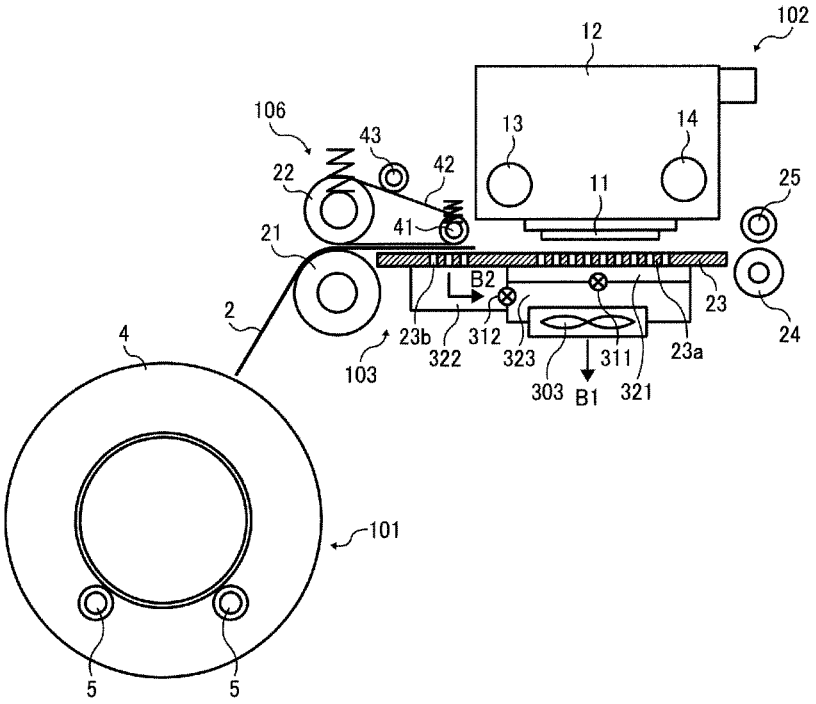
FIG. 10 is a side view of a portion of an image forming apparatus according to an eighth exemplary embodiment of this disclosure.

FIG. 10 is a side view of a portion of an image forming apparatus according to an eighth exemplary embodiment of this disclosure.

The image forming apparatus of the eighth exemplary embodiment includes a first suction passage 321 which is in communication with suction holes 23*a* of a first region, a second suction passage 322 which is in communication with suction holes 23*b* of a second region, and a common suction passage 323 which is in communication with the first suction passage 321 and the second suction passage 322.

A common suction fan 303 is disposed at the common suction passage 323, and the image forming apparatus of the eighth exemplary embodiment includes a first opening and closing unit 311 to open and close between the first suction passage 321 and the common suction passage 323, and a second opening and closing unit 312 to open and close between the second suction passage 322 and the common suction passage 323. That is, the first opening and closing unit 311 opens and closes the first suction passage 321 which is in communication with the suction fan 303 from the first region, and the second opening and closing unit 312 opens and closes the second suction passage 322 which is in communication with the suction fan 303 from the second region.

For such a configuration, when a sucking operation is performed to separate a print medium 2 from the guide belt 42, the second opening and closing unit 312 is opened and the suction fan 303 perform the sucking operation from the second region. When the sucking operation is not performed when the print medium 2 is separated from the guide belt 42, the second opening and closing unit 312 is closed.

When a print medium 2 is conveyed, the first opening and closing unit 311 is maintained in an open state. However, in some embodiments, when the print medium 2 is unlikely to float up or when a printing operation is started and the print medium 2 does not reach a position below a recording head 11, the first opening and closing unit 311 is turned into a closed state.

In the separation of the print medium 2 from the guide belt 42, if a suction force is insufficient because the first opening and closing unit 311 is opened, the suction amount in the first region can be increased by closing the first opening and closing unit 311.

Such a configuration allows the single suction fan to separately perform the suction operation on the first region and the second region.

Here, the common suction fan 303 preferably has a unit for adjusting a rotation speed. Resistances when gas passes in the first opening and closing unit 311 and the second opening and closing unit 312 can be preferably adjusted independently of each other. Such a configuration allows adjustment of the strength of air current generated by the suction fan 303 and the distribution of a suction force to the first region and the second region. As a result, such adjustment can be performed in accordance with the magnitude of an adhesive force of a print medium and the thickness and hardness of the print medium.

When a suction force on the side of the second suction passage 322 is sufficiently strong, for example, in some embodiments, the first opening and closing unit 311 is not provided and the first suction passage 321 is configured to be always in communication with the suction fan 303.

Next, an image forming apparatus according to a ninth exemplary embodiment of this disclosure is described with reference to FIG. 11.

Figure 11:
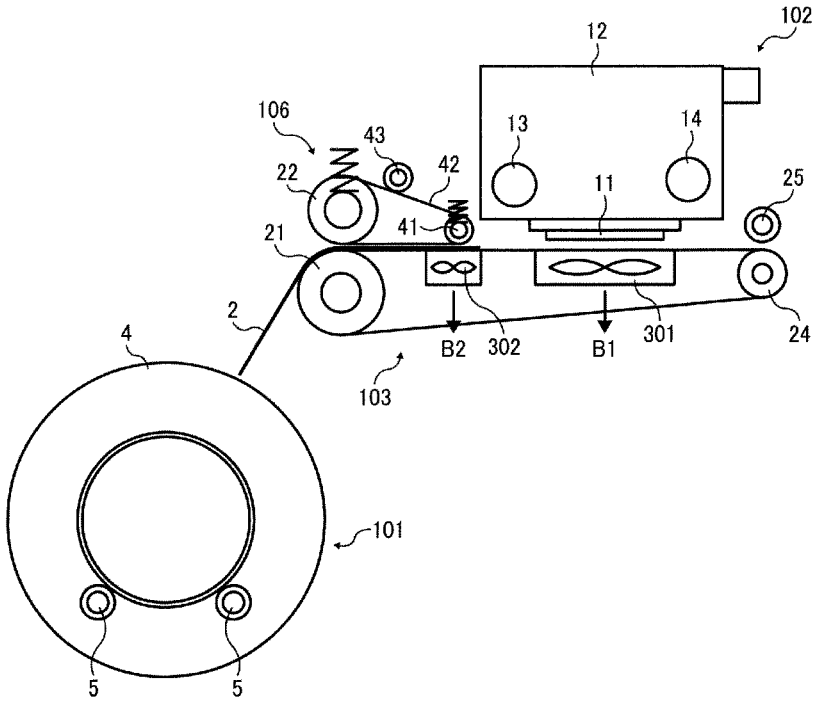
FIG. 11 is a side view of a portion of an image forming apparatus according to a ninth exemplary embodiment of this disclosure.

FIG. 11 is a side view of a portion of an image forming apparatus according to a ninth exemplary embodiment of this disclosure.

For the ninth exemplary embodiment, as shown in FIG. 11, the suction configuration of the sixth exemplary embodiment is applied to the configuration of the fifth exemplary embodiment, thus giving operations effects equivalent to those of the second and sixth exemplary embodiments.

In some embodiments, the configuration of the eighth exemplary embodiment is applicable to the configuration of the fifth exemplary embodiment.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image forming unit to form an image on an adhesive surface of a print medium;

a conveyance unit to convey the print medium to a position at which the print medium opposes the image forming unit with the adhesive surface; and an adhesive-surface guide unit to guide the adhesive surface of the print medium at a position upstream from the image forming unit in a conveyance direction of the print medium, wherein the conveyance unit comprises a pair of rotary bodies to sandwich the print medium between the pair of rotary bodies to convey the print medium and a guide member to support and guide the print medium, the pair of rotary bodies comprising a first rotary body, the adhesive-surface guide unit comprises a second rotary body and an adhesive-surface guide member, the second rotary body disposed at a position downstream from the first rotary body in the conveyance direction, the adhesive-surface guide member having an endless shape and wound around the first rotary body and the second rotary body to guide the adhesive surface, and the adhesive-surface guide unit is configured to press the adhesive-surface guide member against the adhesive surface of the print medium, sandwich the print medium and the adhesive-surface guide member between the pair of rotary bodies, move the print medium and the adhesive-surface guide member together, and separate the adhesive-surface guide member from the adhesive surface at a side of the adhesive-surface guide unit at which the second rotary body is disposed.

2. The image forming apparatus of claim 1, wherein the second rotary body has a smaller diameter than the first rotary body.

3. The image forming apparatus of claim 1, wherein the guide member comprises an absorbing unit to absorb a back surface side of the print medium.

4. The image forming apparatus of claim 1, further comprising a pressing member to press the second rotary body toward the guide member.

5. The image forming apparatus of claim 1, further comprising a third rotary body to give tension to the adhesive-surface guide member between the first rotary body and the second rotary body.

6. The image forming apparatus of claim 1, wherein the adhesive-surface guide member comprises a release layer having a plurality of convex portions on a surface of the release layer.

7. The image forming apparatus of claim 1, further comprising a sheet feeder to draw the print medium from a roll body in which the print medium is formed in a roll shape, and feed the print medium between the pair of rotary bodies, the sheet feeder is configured to support the roll body at a position lower than the pair of rotary bodies and upstream from the pair of rotary bodies in the conveyance direction.

8. The image forming apparatus of claim 1, wherein the guide member is a platen member or a conveyance belt.

9. The image forming apparatus of claim 1, further comprising a plurality of holes provided in the guide member; and a suction unit to separately suck, through the plurality of holes, a first region in which the guide member opposes the image forming unit and a second region in which the guide member opposes the second rotary body.

10. The image forming apparatus of claim 9, wherein the suction unit comprises a first suction fan to suck the first region and a second suction fan to suck the second region.

11. The image forming apparatus of claim 9, wherein the suction unit comprises a common suction fan, a first opening and closing unit to open and close a first suction passage through which the first region is communicated with the common suction fan, and a second opening and closing unit to open and close a second suction passage through which the second region is communicated with the common suction fan.

* * * * *